US009620909B2

(12) United States Patent
Kao et al.

(10) Patent No.: US 9,620,909 B2
(45) Date of Patent: Apr. 11, 2017

(54) INTERFERENCE-PROOF ELECTRICAL PLUG CONNECTOR

(71) Applicant: ADVANCED CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Long-Fei Chen, New Taipei (TW); Yang-Yang Zhou, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/973,078

(22) Filed: Dec. 17, 2015

(65) Prior Publication Data

US 2016/0181734 A1 Jun. 23, 2016

(30) Foreign Application Priority Data

Dec. 23, 2014 (CN) ..... 2014 1 0805179

(51) Int. Cl.

| | |
|---|---|
| ***H01R 13/648*** | (2006.01) |
| ***H01R 13/6585*** | (2011.01) |
| ***H01R 13/6474*** | (2011.01) |
| *H01R 24/60* | (2011.01) |
| *H01R 107/00* | (2006.01) |

(52) U.S. Cl.

CPC ..... *H01R 13/6585* (2013.01); *H01R 13/6474* (2013.01); *H01R 24/60* (2013.01); *H01R 2107/00* (2013.01)

(58) Field of Classification Search

CPC ..... H01R 13/658; H01R 13/6585; H01R 13/6593; H01R 13/504

USPC ..... 439/607.05, 607.55–607.58, 941

See application file for complete search history.

(56) References Cited

U.S. PATENT DOCUMENTS

| | | | | |
|---|---|---|---|---|
| 6,280,209 | B1 * | 8/2001 | Bassler | H01R 12/724 439/101 |
| 6,379,184 | B1 * | 4/2002 | Bassler | H01R 13/6625 439/607.27 |
| 6,454,605 | B1 * | 9/2002 | Bassler | H01R 9/034 439/502 |

(Continued)

*Primary Examiner* — Abdullah Riyami
*Assistant Examiner* — Thang Nguyen
(74) *Attorney, Agent, or Firm* — Rabin & Berdo, P.C.

(57) ABSTRACT

An interference-proof electrical plug connector has an insulative housing, two terminal sets, a shielding-grounding plate and a shell. The terminal sets are mounted in the insulative housing and each terminal sets has multiple conductive terminals. Each terminal set has multiple conductive terminals and at least one pair of super-speed signal terminals. Each super-speed signal terminal has a mounting section including a widening tab laterally protruding from the mounting section toward an adjacent super-speed signal terminal to reduce the distance between the super-speed signal terminals of the pair. The shielding-grounding plate is mounted in a rear end of the insulative housing. The widening tabs of each pair of the super-speed signal terminals effectively diminish impedance of the super-speed signal terminal such that input loss and return loss of the super-speed signal terminals are reduced.

6 Claims, 9 Drawing Sheets

(56) References Cited

U.S. PATENT DOCUMENTS

| | | | | |
|---|---|---|---|---|
| 7,670,199 | B2 * | 3/2010 | Nagata | H01R 13/6474 439/101 |
| 8,147,277 | B1 * | 4/2012 | Wang | H01R 13/506 439/541.5 |
| 2013/0040501 | A1 * | 2/2013 | Peng | H05K 1/0248 439/660 |

* cited by examiner

INTERFERENCE-PROOF ELECTRICAL PLUG CONNECTOR

BACKGROUND OF THE INVENTION

1. Field of the Invention

The present invention relates to a connector, and more particularly to an interference-proof electrical plug connector that widens super-speed signal terminals to lower signal transmission interference such that impedance of terminals are lowered while input loss and return lost are also decreased. Therefore, stability and efficiency of signal transmission of the super-speed signal terminals are improved.

2. Description of Related Art

Electrical connectors are general electrical components on electronic devices widely used for connecting to other matching connectors on the other electrical devices. For example universal serial bus (USB) 3.1 connectors are conventional and products that are available and equipped in variety of electronic devices.

USB 3.1 protocol has been further developed to include USB Type C connector that is able to provide ultrahigh data transmission speed of 10 Gbps and has a light and compact structure especially suitable for portable devices. The USB Type C connector is also featured with a reversible socket for reversible connection for extensive applications on different electrical devices.

The USB type C connector has an insulative housing, two terminal sets and a metal shell. The terminal sets are mounted on the insulative housing, are able to transmit signals. The metal shell covers the insulative housing and the terminal sets. Each terminal set has at least two pairs of terminals serving as signal transmitting terminals for high speed signal transmission. Each terminal has a mounting section, an electrically contacting section and a soldering section. Each signal transmitting signal has a mounting section, an electrically contacting section and a soldering section. The terminals and the signal transmission terminals are arranged abreast at identical intervals such that distances between adjacent two terminals or signal transmission terminals are the same.

However, the signal transmission terminals of the aforementioned USB Type C easily interfered with current or signals on adjacent terminals when operating for signal transmission with high frequency signals passing through the signal transmission terminals. Therefore, high frequency signals cannot stably pass through the signal transmission terminals or signal transmission efficiency diminishes.

To overcome the shortcomings, the present invention provides an interference-proof electrical plug connector to mitigate or obviate the aforementioned problems.

SUMMARY OF THE INVENTION

The main objective of the invention is to provide an interference-proof electrical plug connector that widens super-speed signal terminals to lower signal transmission interference such that impedance of terminals are lowered while input loss and return lost are also decreased. Therefore, stability and efficiency of signal transmission of the super-speed signal terminals are improved.

An interference-proof electrical plug connector in accordance with the present invention comprises an insulative housing, two terminal sets, a shielding-grounding plate and a shell. The terminal sets are mounted in the insulative housing and each terminal sets has multiple conductive terminals. Each terminal set has multiple conductive terminals and at least one pair of super-speed signal terminals. Each super-speed signal terminal has a mounting section including a widening tab laterally protruding from the mounting section toward an adjacent super-speed signal terminal to reduce the distance between the super-speed signal terminals of the pair. The shielding-grounding plate is mounted in a rear end of the insulative housing. The widening tabs of each pair of the super-speed signal terminals effectively diminish impedance of the super-speed signal terminal such that input loss and return loss of the super-speed signal terminals are reduced.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
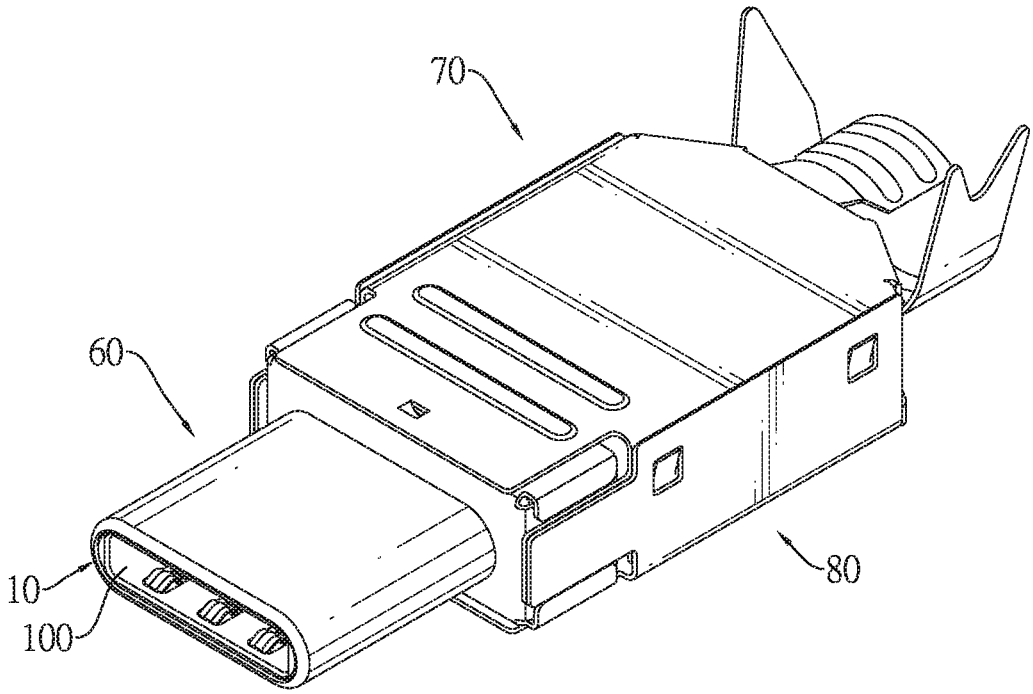
FIG. 1 is a perspective view of an interference-proof electrical plug connector in accordance with the present invention.
Figure 2:
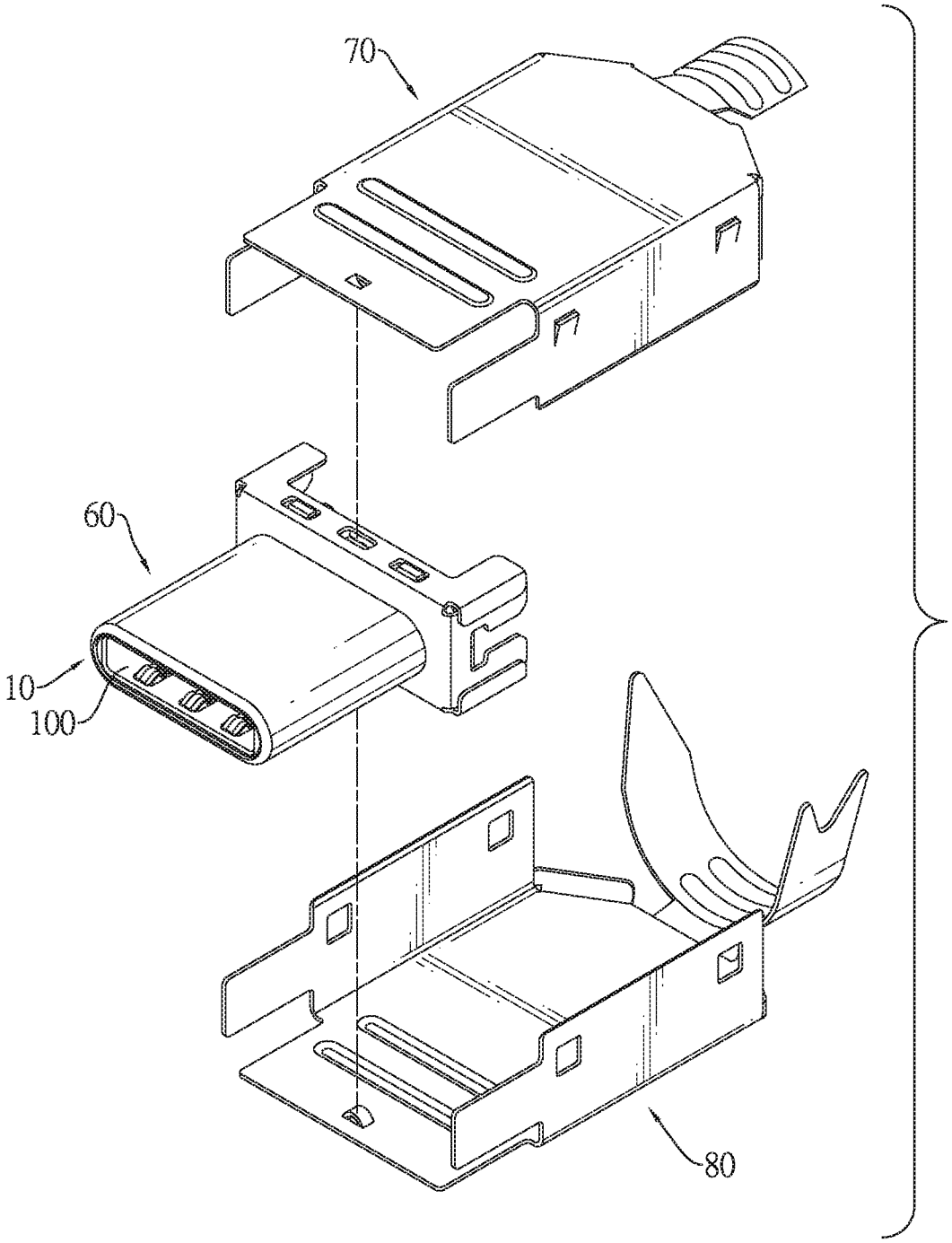
FIG. 2 is a partially exploded perspective view of the interfere-proof electrical plug connector in FIG. 1.

With reference to FIGS. 1 and 2, an electrical plug connector in accordance with the present invention may be a USB Type-C connector, and complies with the USB Type-C Cable and Connector Specification ver. 0.98C set by the USB implementers Forum (USB IF).

Figure 3:
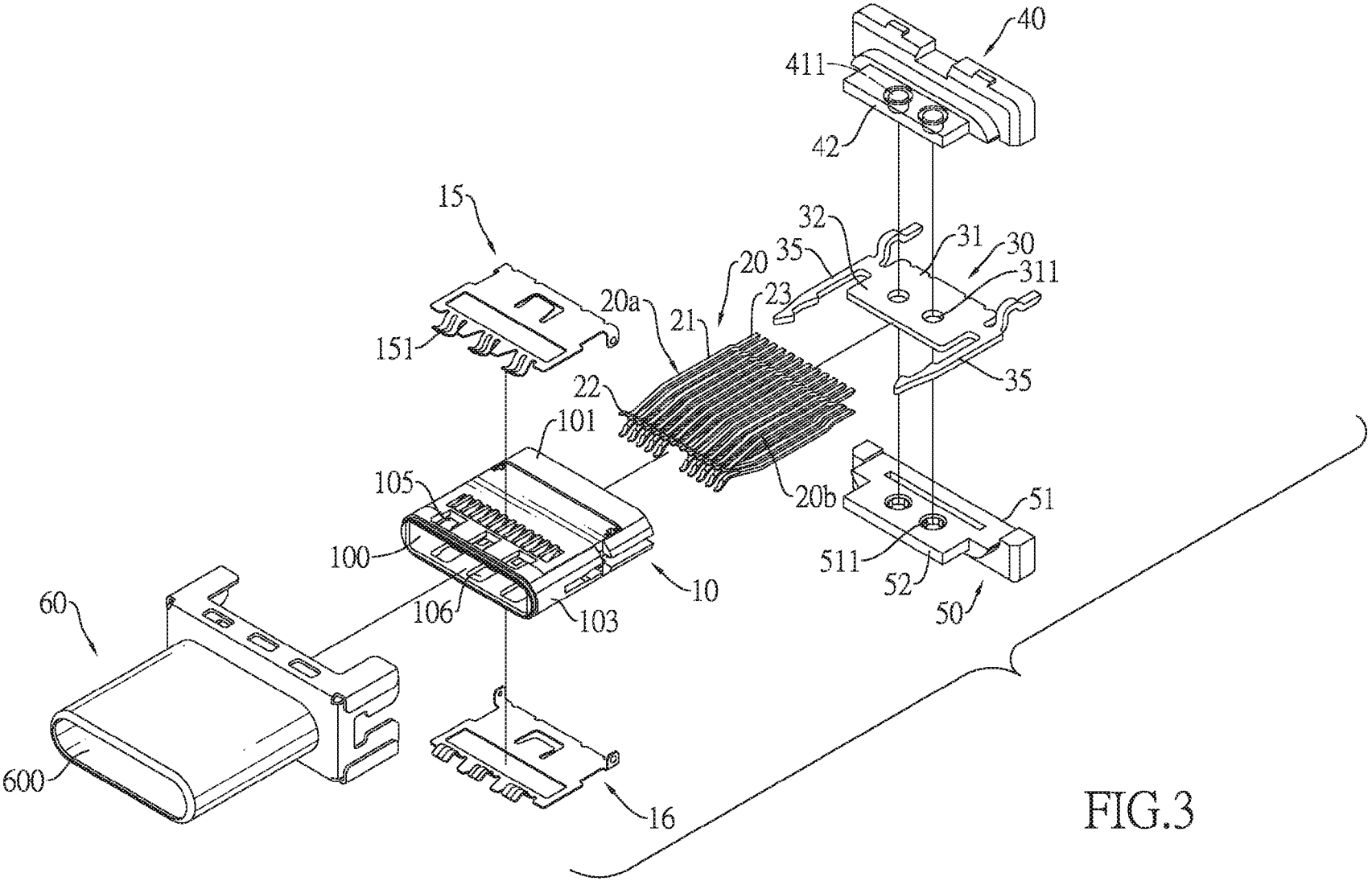
FIG. 3 is an exploded perspective view of the interfere-proof electrical plug connector in FIG. 1 omitting an upper shielding cover and a lower shielding cover.
Figure 4:
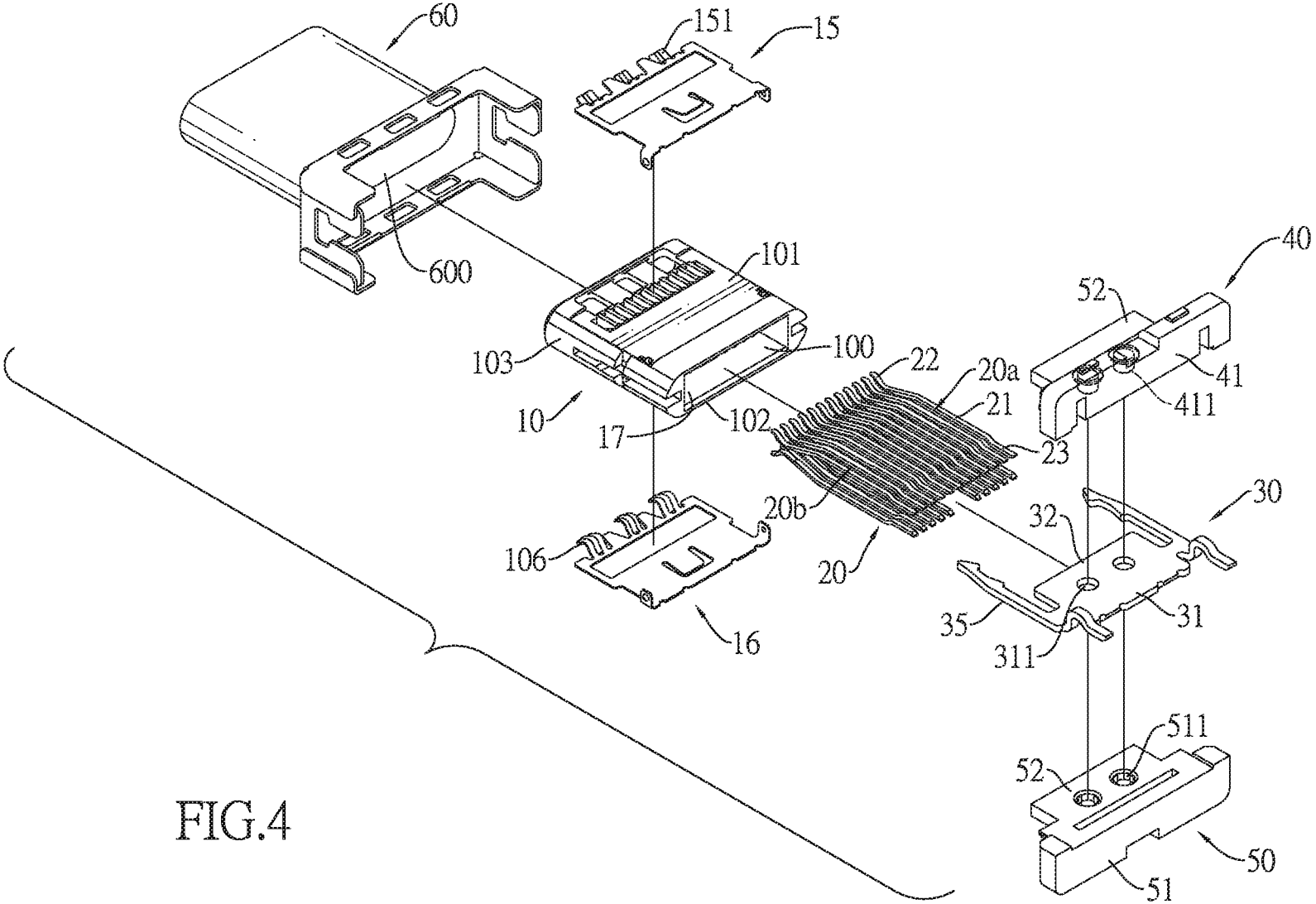
FIG. 4 is another exploded perspective view of the interfere-proof electrical plug connector in FIG. 1 omitting the upper shielding cover and the lower shielding cover.
Figure 5:
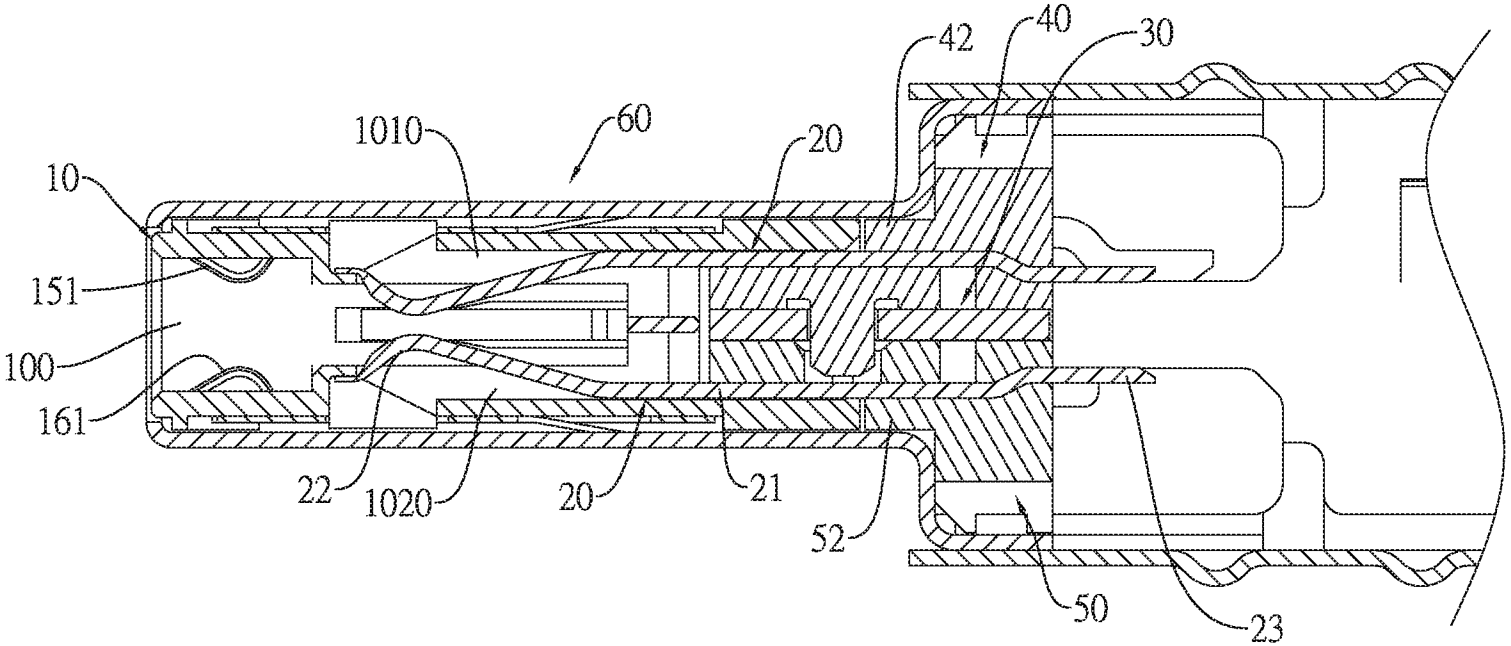
FIG. 5 is an enlarged cross sectional side view of the interfere-proof electrical plug connector in FIG. 1.

With further reference to FIGS. 3 and 4, the electrical plug connector comprises an insulative housing 10, two terminal sets, a shielding-grounding plate 30, an upper rear plug bracket 40, a lower rear plug bracket 50, a shell 60, an upper shielding cover 70 and a lower shielding cover 80.

The insulative housing 10 is substantially horizontally symmetrical and has a top board 101, a bottom board 102, two opposite sidewalls 103, an insertion space 100, an assembling slot 17, an upper pressing element 15 and a lower pressing element 16.

The top board 101 has multiple upper terminal recesses 1010 and multiple upper through holes 105. The upper terminal recesses 1010 are defined in an upper inner surface of the top board 101. The upper through holes 105 are defined through the top board 101 and communicate with the insertion space 100.

The bottom board 102 has multiple lower terminal recesses 1020 and multiple lower through holes 106. The lower terminal recesses 1020 are defined in a lower inner surface of the bottom board 102. The lower through holes 106 are defined through the bottom board 102 and communicate with the insertion space 100.

The sidewalls 103 are located between the top board 101 and the bottom board 102.

The insertion space 100 is defined in a front end of the insulative housing 10 among the top board 101, the bottom board 102 and the sidewalls 103.

The assembling slot 17 is defined in a rear end of the insulative housing 10.

The upper pressing element 15 is mounted on the top board 101 and has multiple upper resilient pressing tabs 151 formed on the upper pressing element 15 and respectively extending through the upper through holes 105 into the insertion space 100.

The lower pressing element 16 is mounted on the bottom board 102 and has multiple lower resilient pressing tabs 161 formed on the lower pressing element 16 and respectively extending through the lower through holes 106 into the insertion space 100.

With further reference to FIGS. 6 to 9, the terminal sets are substantially point symmetrical to each other according to a centre of symmetry of the insertion space 100. According to point symmetrical configuration of the terminal sets, when the terminal sets are rotated for 180 degrees according to the centre of symmetry, the rotated terminal sets coincide with and are the same as the terminal sets without rotation of 180 degrees. By the point symmetrical configuration of the terminal sets, the electrical plug connector is able to extend reversely into a corresponding receptacle connector to normally implement high speed signal transmission. The terminal sets are mounted respectively on the upper inner surface of the top board 101 and the lower inner surface of the bottom board 102.

Figure 6:
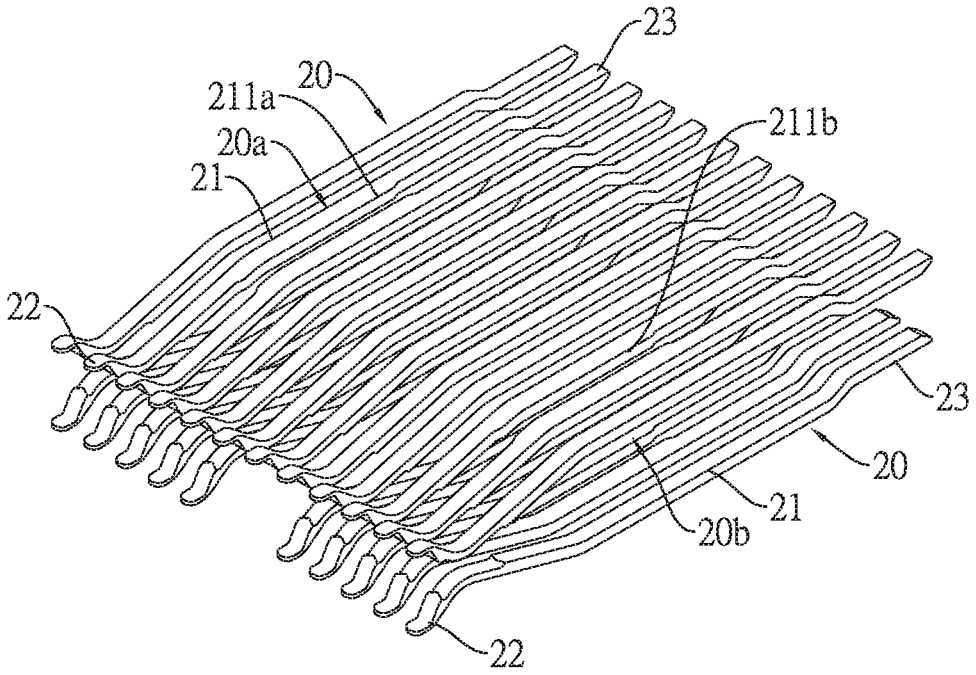
FIG. 6 is a perspective view of two terminal sets of the interfere-proof electrical plug connector in FIG. 3.
Figure 7:
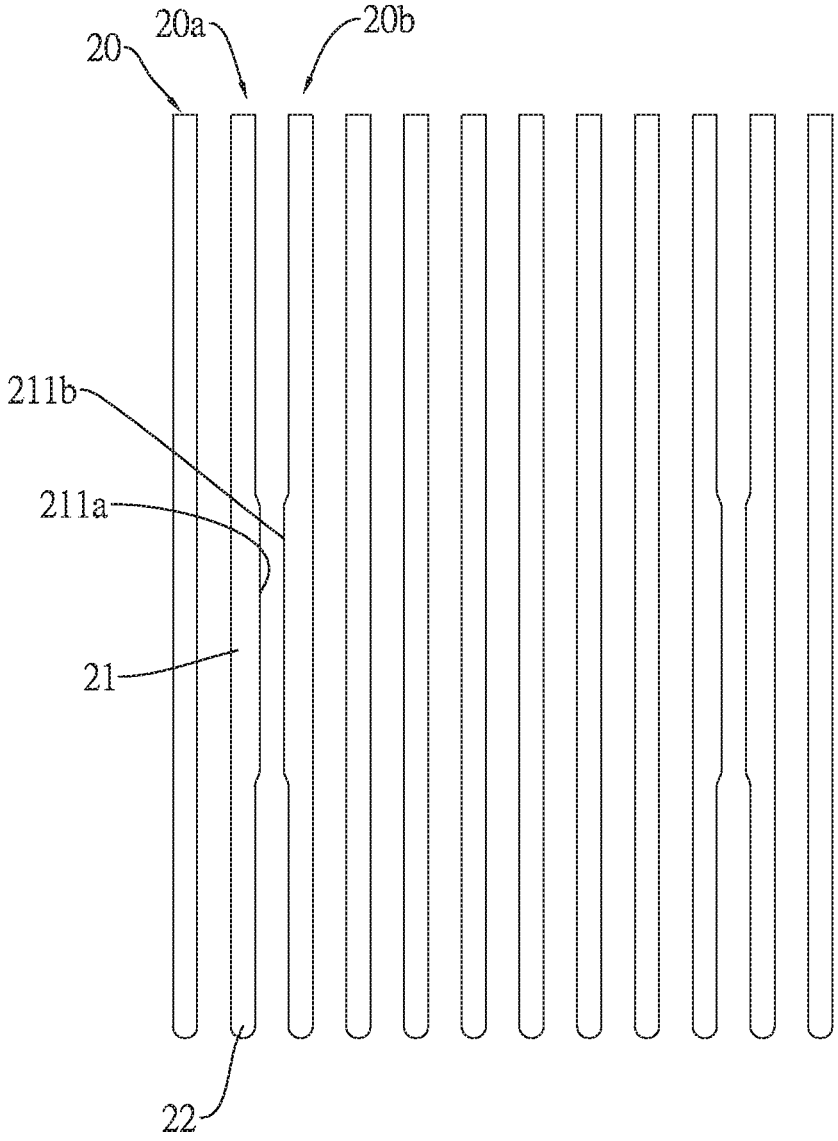
FIG. 7 is a top view of one of the terminal sets of the interfere-proof electrical plug connector in FIG. 6.
Figure 8:
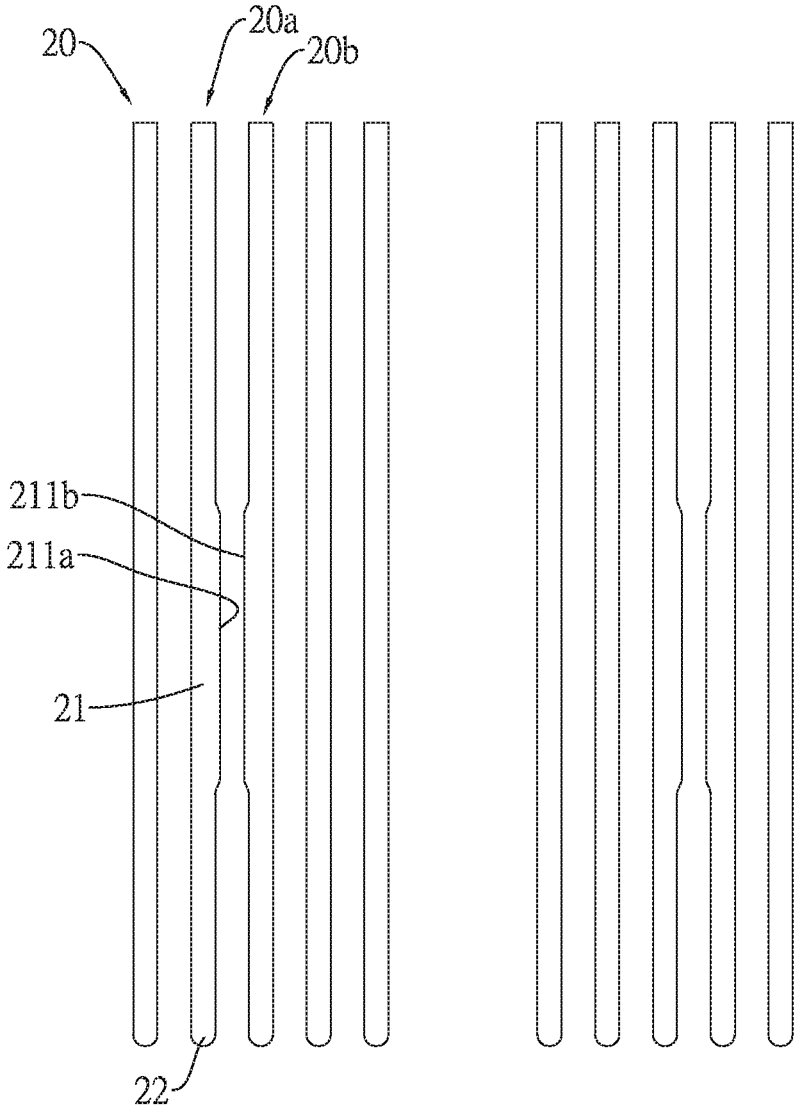
FIG. 8 is a bottom view of the other of the terminal sets of the interfere-proof electrical plug connector in FIG. 6.

Each terminal set has multiple conductive terminals 20 and two pairs of super-speed signal terminals 20*a*, 20*b*. The conductive terminals 20 and the super-speed signal terminals 20*a*, 20*b* of one terminal set are mounted respectively in the upper terminal recesses 1010 of the top board 101 of the insulative housing 10, and the conductive terminals 20 and the super-speed signal terminals 20*a*, 20*b* of the other terminal set are mounted respectively in the lower terminal recesses 1020 of the bottom board 102 of the insulative housing 10. Furthermore, two central conductive terminals are removed from one of the terminal sets, as shown in FIGS. 6 to 8. In other words, one terminal set has twelve conductive terminals and the other terminal set only has ten conductive terminals. One of the terminal sets has less conductive terminals than the other terminal set.

Each conductive terminal 20 has a mounting section 21, an electrical contacting section 22 and a soldering section 23. The mounting section 21 is mounted on the top board 101 or the bottom board 102 of the insulative housing 10. The electrical contacting section 22 is formed on and protrudes forward from the mounting section 21 and extends in the insertion space 100. The soldering section 23 is formed on and protrudes backward from the mounting section 21. The electrical contacting sections 22 of one terminal set are arranged in an upper row, and the electrical contacting sections 22 of the other terminal set are arranged in a lower row aligned with the upper row. The soldering section 23 of one terminal set are arranged in an upper row, and the soldering section 23 of the other terminal set are arranged in a lower row aligned with the upper row.

The super-speed signal terminals 20*a*, 20*b* of each pair are located adjacent to each other. Each super-speed signal terminal 20*a*, 20*b* has a mounting section 21, an electrical contacting section 22 and a soldering section 23. The mounting section 21 is mounted on the top board 101 or the bottom board 102 of the insulative housing 10. The electrical contacting section 22 is formed on and protrudes forward from the mounting section 21 and extends in the insertion space 100. The soldering section 23 is formed on and protrudes backward from the mounting section 21. Furthermore, the mounting section 21 of each super-speed signal terminal 20*a*, 20*b* further has a widening tab 211*a*, 211*b* formed on and protruding from the mounting section 21 of the super-speed signal terminal 20*a*, 20*b*. The widening tabs 211*a*, 211*b* of the super-speed signal terminals 20*a*, 20*b* of each pair extend toward each other such that a distance between the mounting sections 21 of the super-speed signal terminals 20*a*, 20*b* is less than that between the mounting sections 21 of adjacent conductive terminals 20 or that between the mounting sections 21 of adjacent super-speed signal terminal 20*a*, 20*b* and conductive terminal 20. The widening tabs 211*a*, 211*b* of the super-speed signal terminals 20*a*, 20*b* of each pair extending toward each other effectively diminish impedance of the super-speed signal terminals 20*a*, 20*b* such that input loss and return loss of the super-speed signal terminals 20*a*, 20*b* are reduced.

Furthermore, a number of the conductive terminals 20 of one terminal set may be two less than a number of the conductive terminal 20 of the other terminal set to lower cost of material.

The shielding-grounding plate 30 is mounted in the rear end of the insulative housing 10, may be mounted in the assembling slot 17 of insulative housing 10 and has a shielding body 31, an extension shielding sheet 32 and two resilient hooking arms 35.

The shielding body 31 is mounted in the rear end of the insulative housing 10, is located between the terminal sets, may be located between the mounting sections 21 of the conductive terminals 20 of the two terminal sets and has multiple mounting holes 311 defined through the shielding body 31.

The extension shielding sheet 32 is formed on and protrudes forward from the shielding body 31, is mounted in the rear end of the insulative housing 10, may be mounted in the assembling slot 17 of the insulative housing 10 and is located between the mounting sections of the conductive terminals 20 of the two terminal sets.

The resilient hooking arms 35 are formed on and protrude forward respectively from two opposite sides of the shielding body 31 and extend in the insertion space 100 of the insulative housing 10 for firmly clamping and holding a corresponding electrical receptacle connector engaged with the electrical plug connector such that an advertent disengagement of the electrical plug connector from the electrical receptacle connector is prevented.

Figure 9:
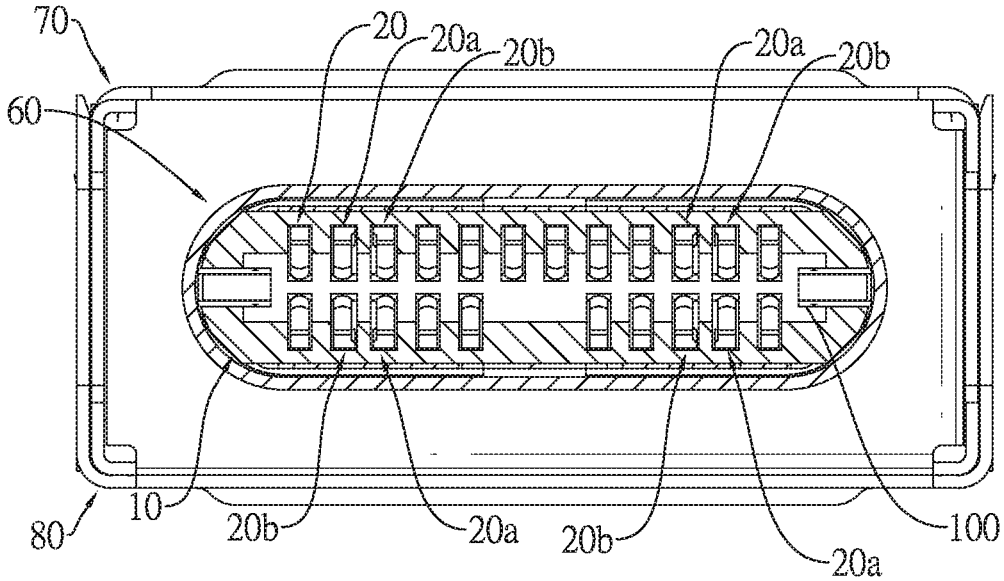
FIG. 9 is a front view of the terminal sets of the interfere-proof electrical plug connector in FIG. 1.

With further reference to FIG. 9, the upper rear plug bracket 40 is mounted to the rear end of the insulative housing 10, is mounted above the shielding-grounding plate 30 and has an upper mounting bracket 41, an upper inserting board 42 and multiple upper mounting protrusions 411.

The upper inserting board 42 is formed on and protrudes forward from the upper mounting bracket 41 and is mounted in the assembling slot 17 of the insulative housing 10.

The upper mounting protrusions 411 are formed on and protrude downward from the upper mounting bracket 41 and are mounted respectively through the mounting holes 311 of the shielding body 31 of the shielding-grounding plate 30.

The lower rear plug bracket 50 is mounted to the rear end of the insulative housing 10, is mounted under the shielding-grounding plate 30 and has a lower mounting bracket 51, a lower inserting board 52 and multiple lower mounting slot 511.

The lower inserting board 52 is formed on and protrudes forward from the lower mounting bracket 51 and is mounted in the assembling slot 17 of the insulative housing 10.

The lower mounting slots 511 are defined in the lower mounting bracket 51 and respectively receive the upper mounting protrusions 411.

The shell 60 is made of metal, is substantially horizontally symmetrical and has a cavity 600 defined in the shell 60 and accommodating the insulative housing 10.

The upper shielding cover 70 and the lower shielding cover 80 cooperate to cover the insulative housing 10, the terminal sets, the upper rear plug bracket 40 and the lower rear plug bracket 50.

The interference-proof electrical plug connector has the following advantages.

1. The widening tabs 211*a*, 211*b* partially widen the super-speed signal terminals 20*a*, 20*b* of each pair to effectively diminish impedance of the super-speed signal terminals 20*a*, 20*b* such that input loss and return loss of the super-speed signal terminals 20*a*, 20*b* are reduced.

2. The resilient hooking arms 35 formed integrally on the shielding-grounding plate 30 provide excellent hooking force to effectively prevent the electrical plug connector from inadvertently disengaging from the corresponding electrical receptacle connector.

3. The upper rear plug bracket 40 and the lower rear plug bracket 50 are mounted simultaneously on the insulative housing 10 and the shielding-grounding plate 30, which improves the structural strength of the electrical plug connector.

4. The upper shielding cover 70 and the lower shielding cover 80 further shield the terminals set from being interfered with external noise.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An interference-proof electrical plug connector comprising:

an insulative housing having a top board, a bottom board, two opposite sidewalls and an insertion space defined in a front end of the insulative housing among the top board, the bottom board and the sidewalls;

two terminal sets being substantially point symmetrical to each other according to a centre of symmetry of the insertion space, and mounted respectively on an upper inner surface of the top board and a lower inner surface of the bottom board, wherein each terminal set has multiple conductive terminals, each conductive terminal having a mounting section mounted on the top board or the bottom board of the insulative housing;

an electrical contacting section formed on and protruding forward from the mounting section and extending in the insertion space; and a soldering section formed on and protruding backward from the mounting section; and at least one pair of super-speed signal terminals, the super-speed signal terminals of each pair located adjacent to each other, and each super-speed signal terminal having a mounting section mounted on the top board or the bottom board of the insulative housing and having a widening tab formed on and protruding from the mounting section, wherein the widening tabs of the super-speed signal terminals of each pair extend toward each other such that a distance between the mounting sections of the super-speed signal terminals of each pair is less than that between the mounting sections of adjacent conductive terminals or that between the mounting sections of adjacent super-speed signal terminal and conductive terminal;

an electrical contacting section formed on and protruding forward from the mounting section and extending in the insertion space; and a soldering section formed on and protruding backward from the mounting section;

a shielding-grounding plate mounted in a rear end of the insulative housing and having a shielding body mounted in the rear end of the insulative housing and located between the terminal sets; and two resilient hooking arms formed on and protruding forward respectively from two opposite sides of the shielding body and extending in the insertion space of the insulative housing; and a shell having a cavity defined in the shell and accommodating the insulative housing;

wherein two central conductive terminals are removed from one of the terminal sets and the conductive terminals of one of the terminal sets are fewer than the conductive terminals of the other terminal set.

2. The interference-proof electrical plug connector as claimed in claim 1, wherein the top board has multiple upper through holes defined through the top board and communicating with the insertion space;

the bottom board has multiple lower through holes defined through the bottom board and communicating with the insertion space;

an upper pressing element is mounted on the top board and has multiple upper resilient pressing tabs formed on the upper pressing element and respectively extending through the upper through holes into the insertion space; and a lower pressing element is mounted on the bottom board and has multiple lower resilient pressing tabs formed on the lower pressing element and respectively extending through the lower through holes into the insertion space.

3. The interference-proof electrical plug connector as claimed in claim 2, wherein the insulative housing has an assembling slot defined in the rear end of the insulative housing;

the shielding-grounding plate has an extension shielding sheet formed on and protruding forward from the shielding body, mounted in the assembling slot of the insulative housing and located between the mounting sections of the conductive terminals of the two terminal sets.

4. The interference-proof electrical plug connector as claimed in claim 3, wherein the shielding body of the shielding-grounding plate has multiple mounting holes defined through the shielding body;

an upper rear plug bracket is mounted on the rear end of the insulative housing, is mounted above the shielding-grounding plate and has an upper mounting bracket;

an upper inserting board formed on and protruding forward from the upper mounting bracket and mounted in the assembling slot of the insulative housing; and multiple upper mounting protrusions formed on and protruding downward from the upper mounting bracket and mounted respectively through the mounting holes of the shielding body of the shielding-grounding plate a lower rear plug bracket is mounted on the rear end of the insulative housing, is mounted under the shielding-grounding plate and has a lower mounting bracket;

a lower inserting board;

a lower inserting board formed on and protruding forward from the lower mounting bracket and mounted in the assembling slot of the insulative housing; and multiple lower mounting slots defined in the lower mounting bracket and respectively receiving the upper mounting protrusions.

5. The interference-proof electrical plug connector as claimed in claim 4 further comprising an upper shielding cover and a lower shielding cover cooperating to cover the insulative housing, the terminal sets, the upper rear plug bracket, and the lower rear plug bracket.

6. The interference-proof electrical plug connector as claimed in claim 5, wherein the top board has multiple upper terminal recesses and multiple upper through holes defined in an upper inner surface of the top board;

the bottom board has multiple lower terminal recesses and multiple lower through holes defined in a lower inner surface of the bottom board; and the conductive terminals and the super-speed signal terminals of one terminal set are mounted respectively in the upper terminal recesses of the top board of the insulative housing, and the conductive terminals and the super-speed signal terminals of the other terminal set are mounted respectively in the lower terminal recesses of the bottom board of the insulative housing.

* * * * *